US009669277B1

(12) United States Patent
Haas et al.

(10) Patent No.: US 9,669,277 B1
(45) Date of Patent: Jun. 6, 2017

(54) BAT WITH PERFORMANCE GOVERNING BARREL AND VIBRATION DAMPENING CONNECTION

(71) Applicant: Rawlings Sporting Goods Company, Inc., St. Louis, MO (US)

(72) Inventors: Michael Haas, Onalaska, WI (US); Tyler Scott Jessie, La Crosse, WI (US); Peter Wiese, La Crosse, WI (US); Doug Heimer, La Crosse, WI (US); Matthew V Vacek, La Crosse, WI (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 32 days.

(21) Appl. No.: 14/099,710

(22) Filed: Dec. 6, 2013

(51) Int. Cl.
*A63B 59/00* (2015.01)
*A63B 59/50* (2015.01)
*A63B 60/54* (2015.01)

(52) U.S. Cl.
CPC ..... *A63B 59/50* (2015.10); *A63B 60/54* (2015.10)

(58) Field of Classification Search
CPC ..... A63B 59/50–59/54; A63B 60/54
USPC ..... 473/564, 566–568
See application file for complete search history.

(56) References Cited

U.S. PATENT DOCUMENTS 3,990,699 A 11/1976 Urmston
4,331,330 A 5/1982 Worst
4,930,772 A 6/1990 Maloney et al.
5,219,164 A 6/1993 Peng
5,593,158 A 1/1997 Filice et al.
6,022,282 A 2/2000 Kennedy et al.
6,176,795 B1 1/2001 Schullstrom
6,398,675 B1 6/2002 Eggiman et al.
6,497,631 B1 12/2002 Fritzke et al.
6,663,517 B2 12/2003 Buiatti et al.
6,702,698 B2 3/2004 Eggiman et al.
6,733,404 B2 5/2004 Fritzke et al.
6,743,127 B2 6/2004 Eggiman et al.
6,761,653 B1 7/2004 Higginbotham et al.
6,863,628 B1 3/2005 Brandt
6,929,573 B1 8/2005 Chang
6,945,886 B2 9/2005 Eggiman et al.
6,949,038 B2 9/2005 Fritzke
7,014,580 B2 3/2006 Forsythe et al.
(Continued)

OTHER PUBLICATIONS http://www.acs.psu,edu/drussell/bats/sting-damp.html.

*Primary Examiner* — Melba Bumgarner
*Assistant Examiner* — Laura L Davison
(74) *Attorney, Agent, or Firm* — Husch Blackwell LLP

(57) ABSTRACT

A bat for striking a ball comprises an axis, a handle, and a barrel. The handle includes a knob end, an attachment end, and a length separating the knob end from the attachment end. The barrel includes an end cap end, a barrel portion, a barrel length, and a transition section. The transition section is operatively attached to the attachment end of the handle. The bat can include a joint connecting the transition section to the attachment end while separating the barrel from the handle. Further, the bat can include an internal tubular member operatively attached to the end cap end and positioned within the barrel. A knob can be attached to the knob end of the handle while an end cap can be attached to the end cap end of the barrel. A grip can be attached to the handle adjacent the knob.

19 Claims, 10 Drawing Sheets

(56) References Cited

U.S. PATENT DOCUMENTS

| | | | | |
|---|---|---|---|---|
| 7,052,419 | B2 * | 5/2006 | Chang | A63B 59/06 473/566 |
| 7,128,670 | B2 | 10/2006 | Souders et al. | |
| 7,201,679 | B2 * | 4/2007 | Nguyen | 473/520 |
| 7,572,197 | B2 | 8/2009 | Chauvin et al. | |
| 7,749,114 | B2 * | 7/2010 | Thouin | A63B 59/06 473/520 |
| 7,867,114 | B2 | 1/2011 | Sutherland et al. | |
| 8,226,505 | B2 * | 7/2012 | Burger | 473/520 |
| 2002/0016230 | A1 | 2/2002 | Okuyama et al. | |
| 2002/0091022 | A1 | 7/2002 | Fritzke et al. | |
| 2005/0070384 | A1 | 3/2005 | Fitzgerald et al. | |
| 2008/0064538 | A1 | 3/2008 | McNamee et al. | |
| 2010/0160095 | A1 | 6/2010 | Chauvin et al. | |
| 2011/0111892 | A1 * | 5/2011 | Thouin et al. | 473/520 |
| 2011/0152015 | A1 | 6/2011 | Burger | |
| 2013/0165279 | A1 | 6/2013 | Chuang et al. | |
| 2013/0274039 | A1 | 10/2013 | Chauvin et al. | |
| 2014/0080642 | A1 | 3/2014 | Epling et al. | |
| 2014/0206483 | A1 * | 7/2014 | Goodwin | A63B 59/06 473/564 |

* cited by examiner

BBS Comparison

| | Max BBS | | | | | |
|---|---|---|---|---|---|---|
| | Test Speed | | | | | |
| | 60 MPH | 70 MPH | 80 MPH | 90 MPH | 100 MPH | 110 MPH |
| Test Bat 1 | - | - | 49.91 | 56.69 | 62.73 | 101.02 |
| Test Bat 2 (TB2) | 40.59 | 46.77 | 53.23 | 59.53 | 65.44 | 99.10 |
| Inventive Bat (New Bat) | 41.79 | 49.21 | 55.89 | 62.85 | 69.13 | 103.25 |
| % diff (New over TB2) | 2.87% | 4.95% | 4.75% | 5.29% | 5.33% | 4.02% |

BAT WITH PERFORMANCE GOVERNING BARREL AND VIBRATION DAMPENING CONNECTION

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications discussed herein are hereby incorporated by reference in their entirety.

FIELD OF THE DISCLOSURE

The present disclosure relates generally to bats used in diamond sports, such as baseball and softball. More particularly, the disclosure relates to a bat having an increased performance based upon the barrel configuration and/or a reduced vibration transfer based upon the connection between the barrel and the handle. The performance advancement can effectively increase the batted ball performance from the bat such that a larger portion of the barrel section can produce a batted ball performance that approximates the maximum batted ball performance allowed by a regulatory agency or body for the particular diamond sport. The reduced vibration advancement can effectively increase the feel of the bat in the batters hands, reduce the "stinging" sensation transmitted to the batters hands when hitting a ball, and may add to the bat performance.

BACKGROUND OF THE DISCLOSURE

It can be appreciated that numerous attempts have been made to improve the performance of a bat. These prior attempts have included the addition of various shells, inserts, materials, and shapes of the bat in order to improve its performance or usage. For example, U.S. Pat. Nos. 7,867,114, 7,014,580, 6,949,038, 6,761,653 6,733,404, 6,663,517, 6,497,631, 6,398,675, 6,176,795, 6,022,282, 4,930,772, 4,331,330, and 3,990,699, and U.S. Patent Application Publication Nos. 2002/0016230, 2002/0091022, 2005/0070384, 2010/0160095, 2011/0152015, 2013/0274039, and 2013/0165279 disclose various attempts to improve the performance or use of a bat.

The performance of a bat is generally based upon the weight of the bat, length of the bat, and the impact response of the bat at and during impact with a ball. Most of the focus for improvements in bat technology has been in improving the performance of the preferred impact area, or "sweet spot". As the prior art bats have increased the performance in this area, many of the sports regulatory agencies have placed performance and/or configuration restrictions on the bats. For example, most regulatory bodies set a maximum performance level of a bat when a ball impacts the preferred impact area, or sweet spot, of that bat. Typically, this impact performance level is measured from the speed of the ball off the bat right after impact. The sweet spot is approximately four to eight inches, and usually five to seven inches, from the end cap end of the bat barrel and is the location on the bat that will typically produce the greatest batted ball performance.

Historically, the performance of a bat in areas adjacent to the sweet spot of that bat show significant reductions in performance. The contemporary bat art has made few attempts to improve the performance of the bat sections adjacent the preferred impact area. As such, the performance of the bats in areas distal from, and even adjacent to, the sweet spot dramatically drops for the conventional bats. The portion of the prior art that has attempted to address this need has drawbacks.

Further, the bat art has attempted to improve a batter's enjoyment, and to some level the batter's performance, of the batted ball game. This enjoyment can be substantially affected by the "feel", or perception, a batter has with a particular bat. Some of this qualitative "feel" concept is controlled by the management of the vibrational energy transferred, or imparted, to the hands of the batter when a ball impacts the barrel of the bat. The concept, also known as shock or "sting", is well known in the art. There have been numerous attempts to improve a batter's enjoyment by controlling the energy transfer to his/her hands.

For example, U.S. Pat. Nos. 7,572,197, 7,201,679, 7,128,670, 6,945,886, 6,929,573, 6,863,628, 6,743,127, 6,702,698, 5,593,158, 5,219,164, and U.S. Patent Application Publication Nos. 2008/0064538 and 2011/0111892 disclose various attempts to improve the energy control or the shock attenuating features of a bat. Most of these prior attempts involve complicated structures, are ineffective in the energy dissipation, and/or substantially decrease the batted ball performance of the bat when so constructed.

Thus, there is a continuing need for improved overall performance of bats. These improved bats need to conform to the regulatory agencies' restrictions in the preferred hitting zone while performing well at locations location that are longitudinally outside the preferred hitting zone. These improved bats preferably increase the performance in locations adjacent the preferred hitting area/zone as compared to the preferred hitting zone. These improved bats, or features of a bat, are lacking in the art.

Further, there is a need for bats that facilitate a controlled energy transfer between the bat and the batter's hands upon a struck ball. These improved bats preferably facilitate an improved comfort to the batter while maintaining desired performance levels in the bat. These improved bats, or features of a bat, are lacking in the art.

BRIEF SUMMARY OF THE EMBODIMENTS

Disclosed herein is a bat for striking a ball. The bat comprises an axis, a handle, and a barrel. The handle includes a knob end, an attachment end, and a length separating the knob end from the attachment end. The barrel includes an end cap end, a barrel portion, a barrel length, and a transition section. The transition section is operatively attached to the attachment end of the handle. The bat can include a joint connecting the transition section to the attachment end while separating the barrel from the handle. Further, the bat can include an internal tubular member operatively attached to the end cap end and positioned within the barrel. A knob can be attached to the knob end of the handle while an end cap can be attached to the end cap end of the barrel. A grip can be attached to the handle adjacent the knob.

In an embodiment, the joint connects the transition section to the attachment end and includes a collar, a securing device, and a polyurethane spacer. The collar can be attached to the attachment end of the handle and to the transition section of the barrel. The securing device can be attached to the handle proximate to the collar and opposite the knob end of the handle. The polyurethane spacer can be attached to the handle and to the collar with the spacer positioned to separate at least a portion of the collar from the attachment end of the handle.

In a bat made in accordance with the current disclosure, the transition section can define a handle opening opposite the end cap end of the barrel. Further the securing device can be annular in shape and include an outside diameter that is larger than the handle opening. The collar can include an internal diameter that is smaller than the outside diameter of the securing device, while the securing device can be spaced from the collar when attached to the handle.

The joint can further include an external covering positioned on the collar proximate to the transition section. The external covering can be substantially flushed with the transition section and can engage the handle and collar. An internal support can be positioned in the attachment end of the handle such that the internal support is aligned along the axis of the bat and extends past the transition section of the barrel towards the knob end. Further the polyurethane spacer can have a hardness of between approximately 40-60 Shore A.

A bat made in accordance with the current disclosure can include an internal tubular member positioned within the barrel and operatively attached to the end cap end. The internal tubular member can extend towards the transition section of the barrel and can include a consistent internal diameter, an increasing outside diameter, and a length. The increasing outside diameter can increase proximate to the preferred hitting area of the barrel portion.

The preferred hitting area of the barrel portion can include an axial length, wherein the increasing outside diameter of the internal tubular member is substantially consistent from the end cap end to the axial length of the preferred hitting area of the barrel portion. The increasing outside diameter can increase along the axial length of the preferred hitting area of the barrel portion. The preferred hitting area of the barrel portion can be described as having a starting location spaced from the end cap end and an ending location positioned between the starting location and the transition section. The increasing outside diameter of the internal tubular member can expand proximate to the starting location and end proximate to the ending location of the preferred hitting area. This internal tubular member can restrict the deflection of the preferred hitting area of the barrel portion when that preferred hitting area deflects upon contact with a ball.

It is contemplated that a bat made in accordance with this disclosure can have the barrel governance, as with the internal tubular member, or the vibration reduction, as with the joint, or both.

It is therefore a general object of the present disclosure to provide a bat with an improved batted ball performance.

Another object of the present disclosure is to provide a bat that meets regulatory standards in the preferred hitting area as well as the areas adjacent to the preferred hitting area.

Yet another object of the present disclosure is to provide a bat having an improved barrel.

Another object of the present disclosure is to enlarge the effective preferred hitting area of the bat.

Still another object of the present disclosure is to provide a bat having an enlarged sweet spot.

Yet another object of the present disclosure is to provide a bat having an improved connection between the handle and barrel.

Another object of the present disclosure is to provide a bat having a connection between the handle and barrel that regulates energy transfer between the handle and barrel.

Still another object of the present disclosure is to provide a bat having a connection between the handle and barrel that reduces the "sting" felt by a user of the bat.

Other and further objects, features and advantages of the present disclosure will be readily apparent to those skilled in the art upon reading of the following disclosure when taken in conjunction with the accompanying drawings.

DETAILED DESCRIPTION OF THE EMBODIMENTS

Figure 1:
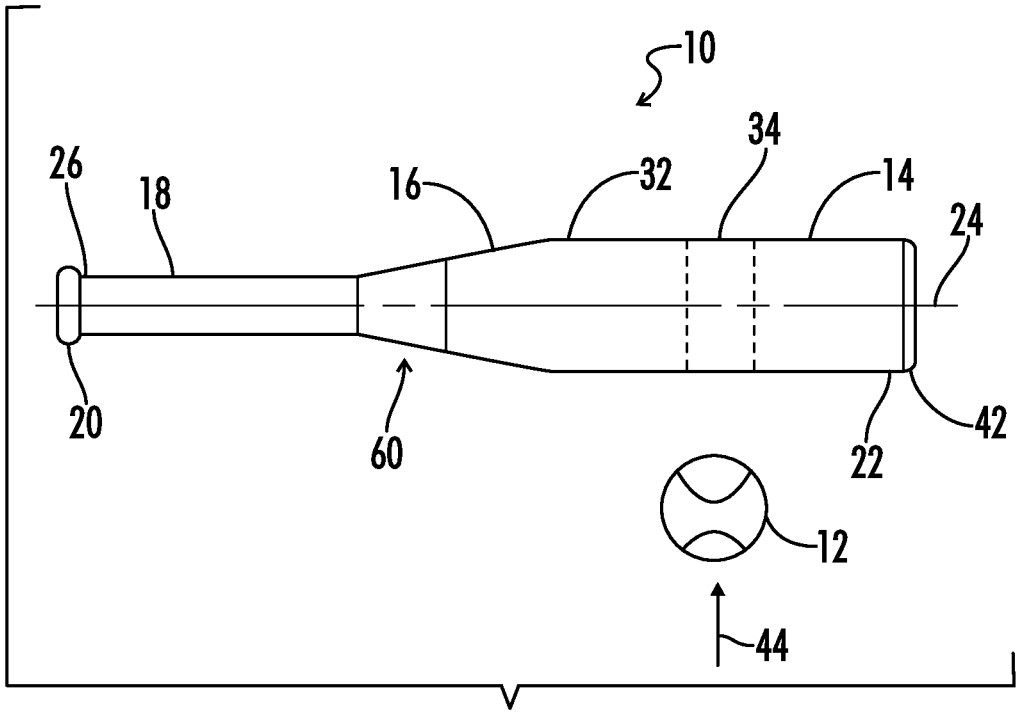
FIG. 1 is a side view of a bat made in accordance with the current disclosure.
Figure 2:
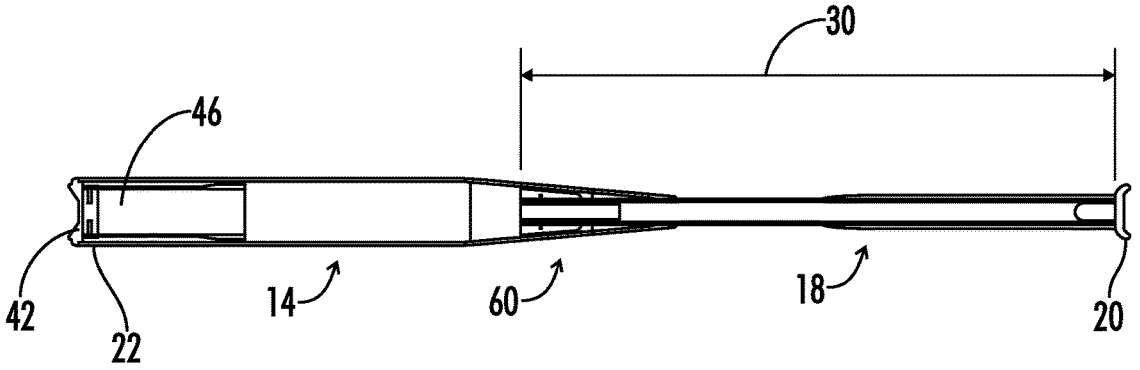
FIG. 2 is a cross-sectional view of the bat shown in FIG. 1.
Figure 3:
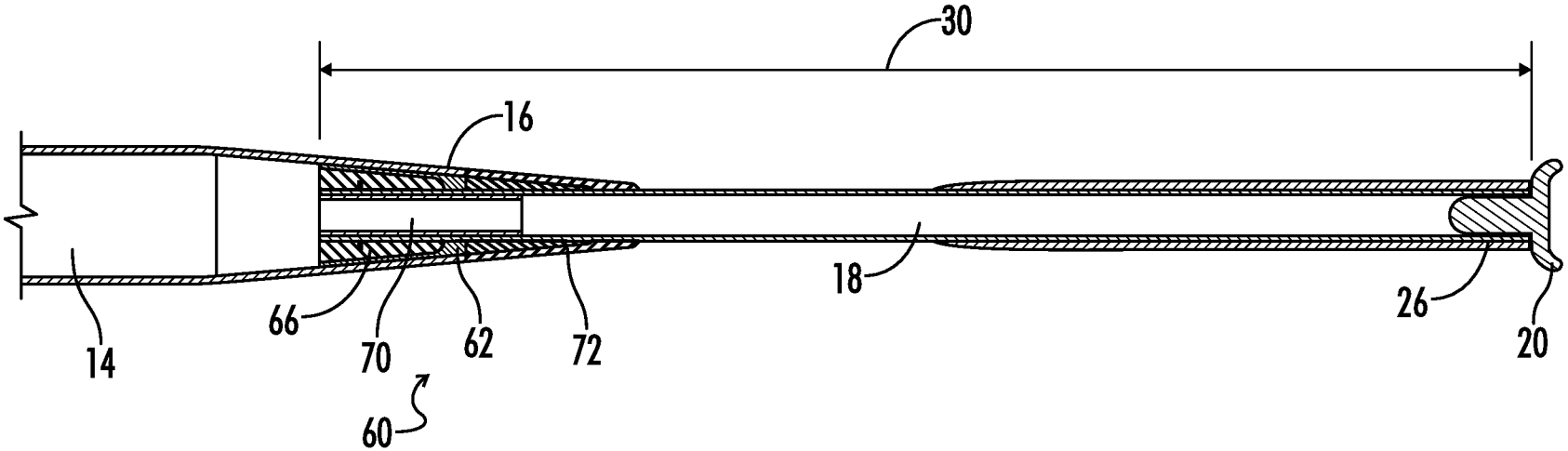
FIG. 3 is a detailed view of a portion of the bat shown in FIG. 2.

Referring generally now to FIGS. 1-10, shown and generally designated by the numeral 10 is an embodiment of a bat of the present disclosure. The bat 10 is for hitting a ball 12 in a game, such as a diamond sport game, like baseball or softball. The bat 10 includes an axis 24 and a barrel 14 having a transition section 16. A handle 18 is operatively attached to the transition section 16 and can have a knob end 26 that attaches to a knob 20 the transition section 16. An attachment end 28 of the handle 18 can operatively engage the transition section 16 of the barrel 14. The handle 18 can have an overall length 30 that can separate the knob end 26 from the attachment end 28. Preferably that length 30 of the handle 18 positions the attachment end 28 such that it terminates proximate to the transition section 16. Alternately, the handle 18 can end within the transition section 16.

The barrel 14 can have an end cap end 22 and a barrel portion 32 that is sized and positioned for contact with the ball 12. An end cap 42 can be secured to the end cap end 22 of the barrel 14. In the barrel portion 32, a preferred hitting area 34 can be positioned. This preferred hitting area 34 is spaced between the end cap end 22 and the transition section 16. The preferred hitting area is typically located approximately 4-8 inches, and usually between 5-7 inches, from the end cap end 22 of the barrel 14. This location of the preferred hitting area 34 can be described as having an axial length 36. Alternately described, the preferred hitting area 34 can have a starting location 38 spaced from the end cap end 22 and an ending location 40 positioned between the starting location 38 and the transition section 16. It is the preferred hitting area 34 that conventionally produces the largest batted ball performance when a ball 12 is affected by a force 44 to the bat 10.

In an embodiment of the bat 10, an internal tubular member 46 is positioned within the barrel 14 and is operatively attached to the end cap end 22. This internal tubular member 46 can be attached to the end cap 42 by a mechanical fixture or adhesion. Other methods of attachment between the internal tubular member 46 and the end cap 42 or the end cap end 22 will be readily apparent to one skilled in the art.

For example, the internal tubular member 46 can be friction fit onto the end cap 42 and then that assembly can be placed into the end cap end 22 of the barrel 14. The end cap and internal tubular member assembly can then be fixed to the end cap end 22, such as by adhesion. For example, polyurethane can be used to secure the end cap and internal tubular member assembly in place. Additional mechanical locking elements, such as tongue and groove configurations, can also be used to facilities securement of the end cap and internal tubular member assembly into the barrel 14. For example, one or more pins 56 can be used to secure the internal tubular member 46 to the end cap 42, and adhesive can further reinforce the connection of the end cap and internal tubular member assembly into the barrel 14.

Figure 8:
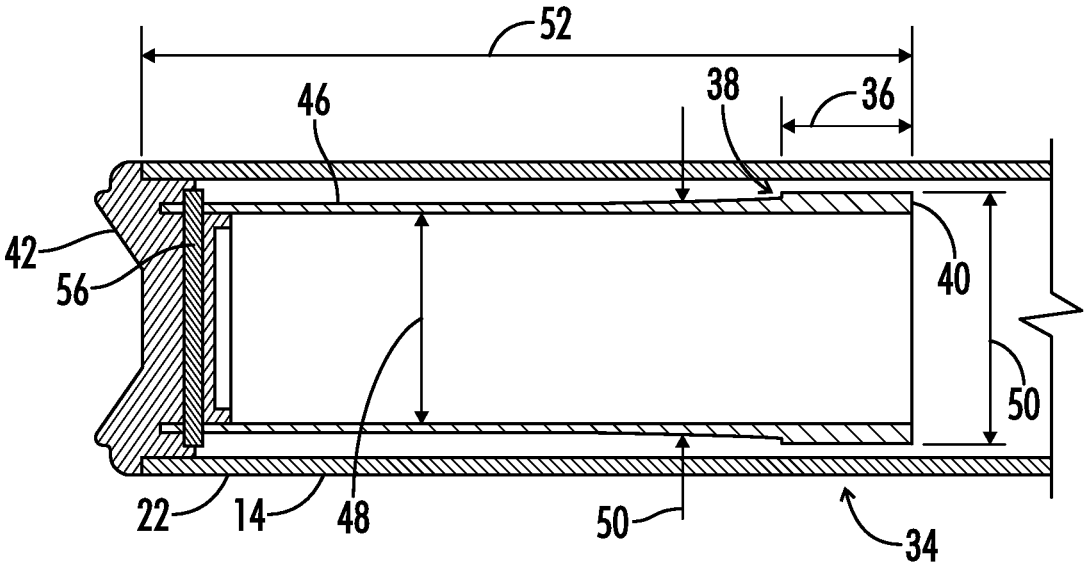
FIG. 8 is a detailed cross sectional view of the barrel of a bat made in accordance with current disclosure.
Figure 9:
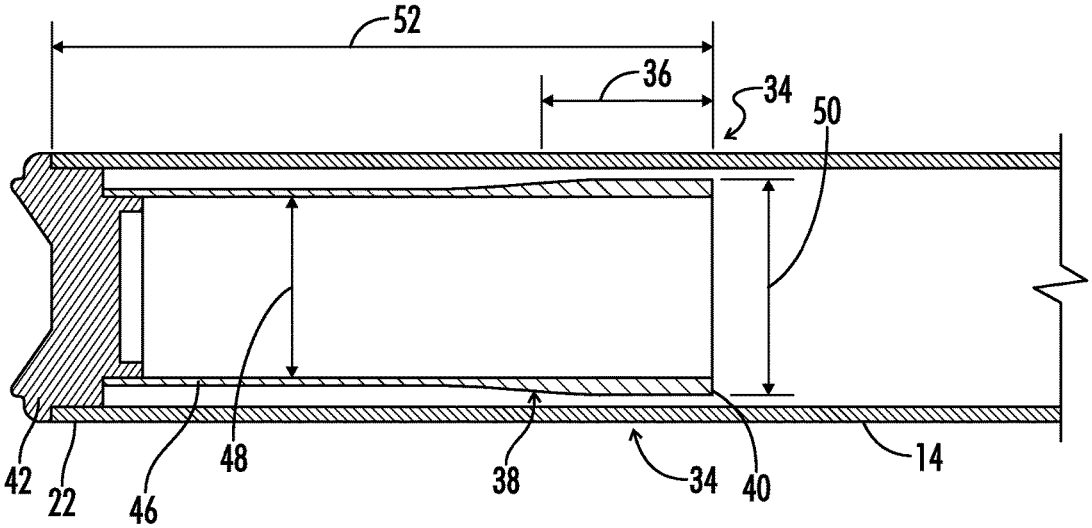
FIG. 9 is a detailed cross sectional view of the barrel of the bat shown in FIG. 2.

In an embodiment, the internal tubular member 46 extends toward the transition section 16 from the end cap end 22. The internal tubular member 46 can include a consistent internal diameter 48, an increasing outside diameter 50, and a length 52. The outside diameter 50 increases at a location proximate to the preferred hitting area 34 of the bell portion 32 as best seen in FIGS. 8-9.

The outside diameter 50 of the internal tubular member 46 can be described as expanding proximate to the starting location 38 of the preferred hitting area 34 and extending to the ending location 40 of the preferred hitting area 34. In this embodiment, the internal tubular member 46 has a substantially consistent outside diameter 50 from its engagement to the end cap 42 at the end cap end 22. This outside diameter 50 can remain spaced from the barrel portion 32 as the internal tubular member 46 extends along the axis. As the internal tubular member extends along the axis 24 of the bat 10, the outside diameter 50 can begin to expand towards the barrel portion 32 proximate to the starting location 38 of the preferred hitting area 34. This expanded portion of the outside diameter 50 can continue to approximately the ending location 40 of the preferred hitting area 30. In this configuration, the outside diameter 50 is closer to the barrel portion 34 along the axial length 36 of the preferred hitting area 34 than other locations along the length 52 of the internal tubular member 46.

This configuration of the internal tubular member facilitates engagement between the barrel portion 32 and the internal tubular member 46. More specifically, this configuration facilitates engagement of the outside diameter 50 of internal tubular member 46 and the preferred hitting area 34 of the barrel portion 32 when a ball 12 strikes the preferred hitting area 34 of the bat 10. This engagement can reduce the performance, such as the batted ball speed, of a ball 12 struck from the preferred hitting area 34. This allows the bat 10 to have a modified performance level.

In this configuration, the areas adjacent to the preferred hitting area 34 can have a higher performance level then conventionally possible. In a conventional bat, the performance curve is generally "bell" shaped with the highest performance at the sweet spot. Since the sweet spot is the location tested by most regulatory bodies, the top of the "bell" curved performance must be below the performance restrictions. This necessitates the rest of the performance is decidedly below that performance level also.

The current barrel configuration allows a bat to be constructed that has a hitting section with a performance that meets, or approximates, the top regulated performance level over a greater length of the barrel section—a section extending longer than just the sweet spot. For example, a bat can be configured such that the performance level at the preferred hitting area would exceed regulatory restrictions. In this bat, the areas adjacent to the preferred hitting area would meet or approximate the maximum performance level. Once the internal tubular member 46 is positioned within the barrel 14, the force applied to the preferred hitting area 34 will facilitate the engagement of the outside diameter 50 and the internal surface of the preferred hitting area 34. This will reduce the overall performance of that preferred hitting area 34, thus bringing the bat within the performance limitations of the regulatory bodies. The resulting bat performance level that departs from the traditional bell curved shaped performance and has more of a plateaued shaped performance with a larger portion of the bat at the maximum performance level.

In another embodiment of a bat made in accordance with the current disclosure, a joint 60 is included. The joint 60 can connect the transition section 16 of the barrel 14 to the attachment end 28 of the handle 18. This joint 60 can separate the barrel 14 from the handle 18. The joint can include a collar 62 attached to the portion of the handle adjacent the attachment end 28 and attached to the transition section 16. A securing device 64 can attach to the handle 18 proximate to the collar 62 and opposite the knob end 26. A polyurethane spacer 66 can attach to the handle 18 and collar 62. The polyurethane spacer 66 can be positioned to separate at least a portion of the collar 62 from the attachment end 28 of the handle 18.

The transition section 16 of the barrel 14 can define a handle opening 54 positioned opposite the end cap end 22. A portion of the handle 18 adjacent the attachment end 28 is received in the handle opening, and the barrel 14 overlaps with the handle 18 along an overlap 78. The securing device 64 can have an annular shape and include an outside diameter that is larger than the handle opening 54. Further, the collar 62 can include an internal diameter 68 that is smaller than the outside diameter 65 of the securing device 64. This securing device 64 can maintain the connection between the handle 18 and barrel 14 if part of the connection in the joint 60 is lost.

Collar 62 includes an annular collar ring portion 80 having an inner bore 82, and the collar 62 includes a tapered collar sleeve portion 84 extending from the collar ring portion 80 toward the barrel end cap 42. The tapered collar sleeve portion 84 has an inner surface 86 and an outer surface 88. The inner bore 82 of the ring portion 80 of collar 62 can be adhered to the attachment end 28 of the handle 18. The securing device 64, which can be a ring like structure, can be press fit onto the attachment end 28 of the handle 18. This securing device 64 can be spaced from the inner surface 86 of the tapered collar sleeve portion 84 of the collar 62. Next, a polyurethane spacer 66 can be filled within the gap 90 between the tapered collar sleeve portion 84 of the collar 62 and the attachment end 28. The handle 18 and joint assembly with the collar 62, securing device 64, and polyurethane spacer 66 can be adhered to the transition section 16 of the barrel 14. More specifically, the outsidc portion outer surface 88 of the collar 62 can be adhered to the internal portion surface of the transition section 16.

The polyurethane spacer 66 can be applied in liquid form and allowed to harden. When hardened, the polyurethane spacer can have a hardness of between approximately 40-60 Shore A. Alternately, the polyurethane spacer 66 can have a hardness of between approximately 45-55 Shore A. Alternately. the polyurethane spacer 66 can have a hardness of approximately 50 Shore A. This level of hardness allows some flexibility and movement of the handle 18 at the attachment end 28 in relation to the transition section 16 of the barrel 14. This is represented by line 74. The polyurethane spacer 66 can also absorb vibrational energy transmitted along the barrel 14 from an impact of a ball 12 before that energy is transferred to the handle 18 and onto the hands of a user.

Figure 4:
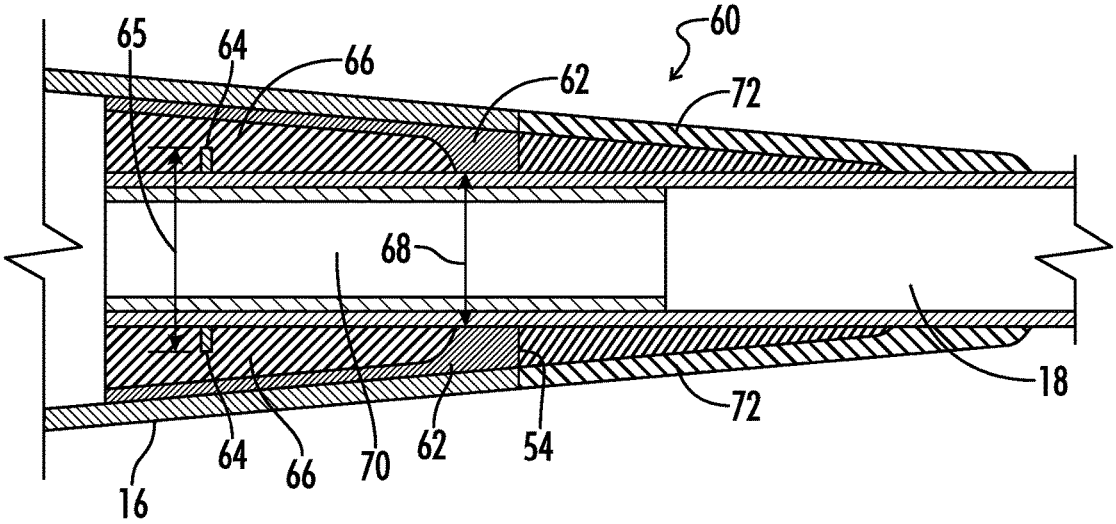
FIG. 4 is a detailed view of the joint area of the bat shown in FIGS. 2-3.
Figure 5:
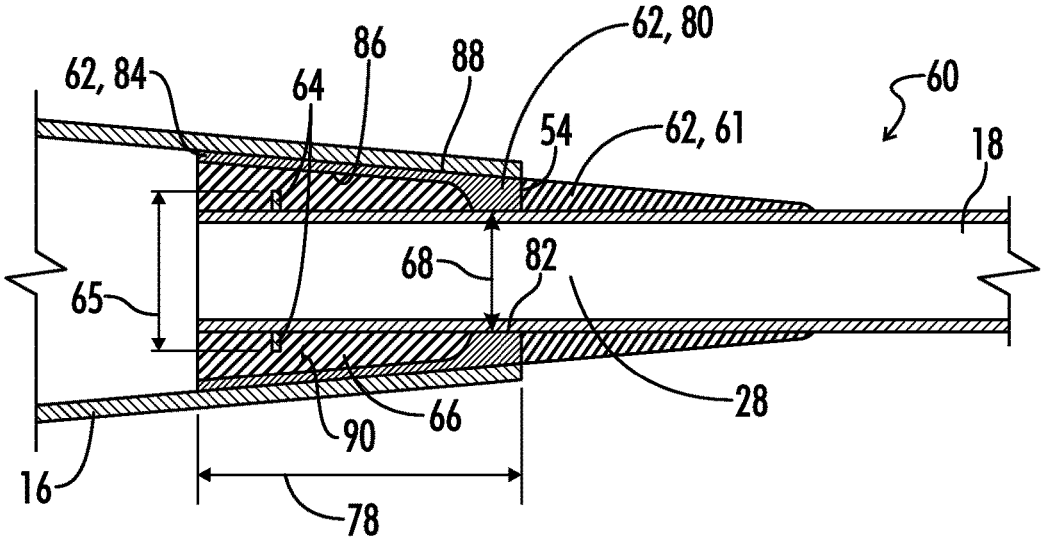
FIG. 5 is a detailed cross sectional view of the joint area of a bat made in accordance with current disclosure.
Figure 6:
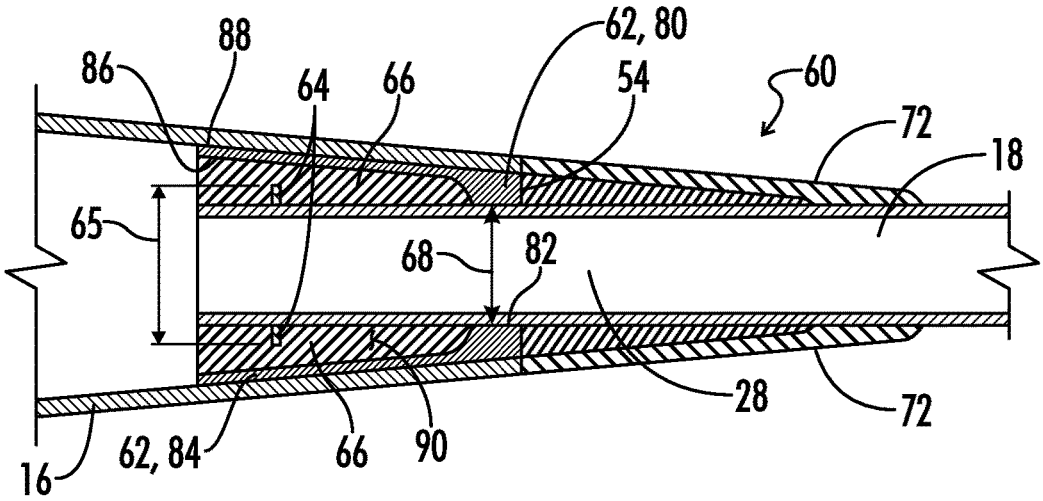
FIG. 6 is a detailed cross sectional view of the joint area of a bat made in accordance with current disclosure.
Figure 7:
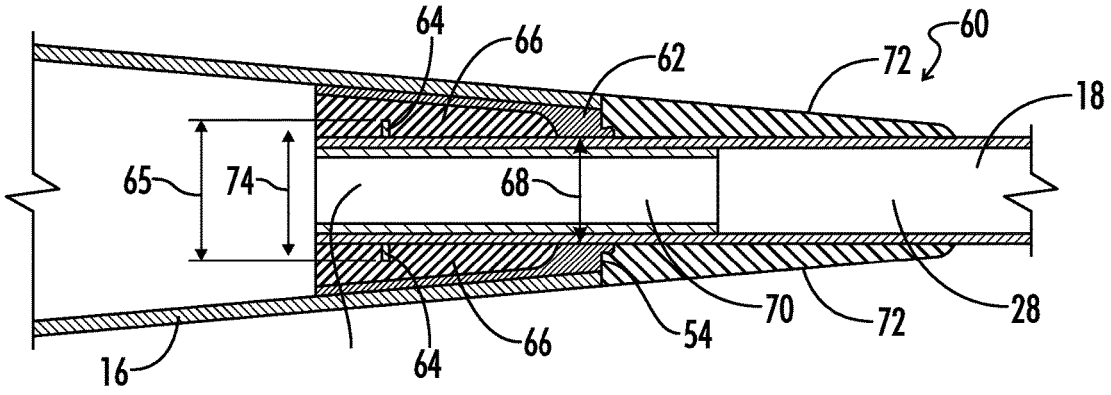
FIG. 7 is a detailed cross sectional view of the joint area of a bat made in accordance with current disclosure.

The collar can be shaped such that an extension portion 61 extends past the handle opening 54 of the transition section 16, as best seen in FIGS. 5 and 6. Alternately, the collar 62 can end proximate the end of the transition section 16 at the handle opening 54, as best seen in FIGS. 4 and 7. An external covering 72 can be positioned proximate to the collar 62. This external covering 72 can provide additional support to the joint 60. The external covering 72 can be cosmetic in nature and allow for a smooth transition from the transition section 16 to the handle 18. This is best seen in FIGS. 4, 6, and 7. This external covering 72 can be substantially flush with the transition section 16 and can engage the handle 18 and the collar 62.

An internal support 70 can be positioned in the attachment end 28 of the handle 18. The internal support 70 is preferably friction fit within the attachment end 28 of the handle 18 and can provide additional strength to the attachment end 28. The internal support 70 can extend to the end of the attachment end 28 and be substantially even with or extend past the end of the collar 62 as seen in FIGS. 4 and 7. In a preferred embodiment, the internal support 70 is comprised of metal, such as aluminum, while the handle 18, barrel 14, and internal tubular member 46 are composed of composite.

Figures 10, 11:
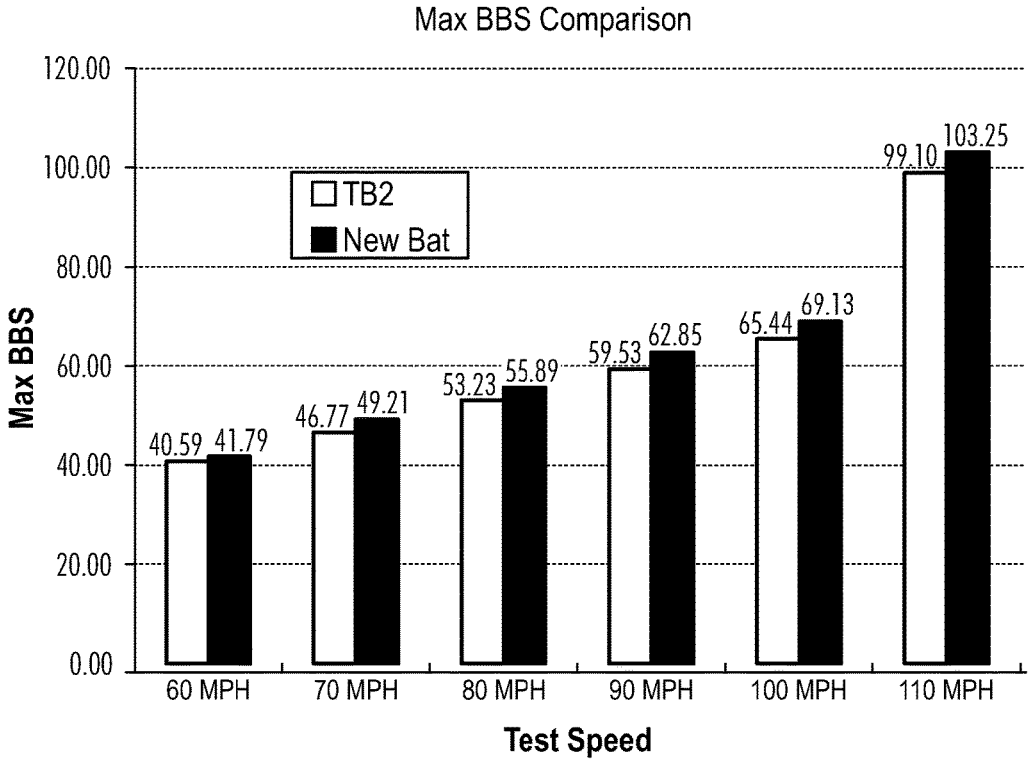
FIG. 10 is a chart of test data showing the batted ball speed of two test bats and a bat made in accordance with current disclosure.
FIG. 11 is a graph of the test data of FIG. 10 between test bat 2 and a bat made in accordance with current disclosure.
Figure 12:
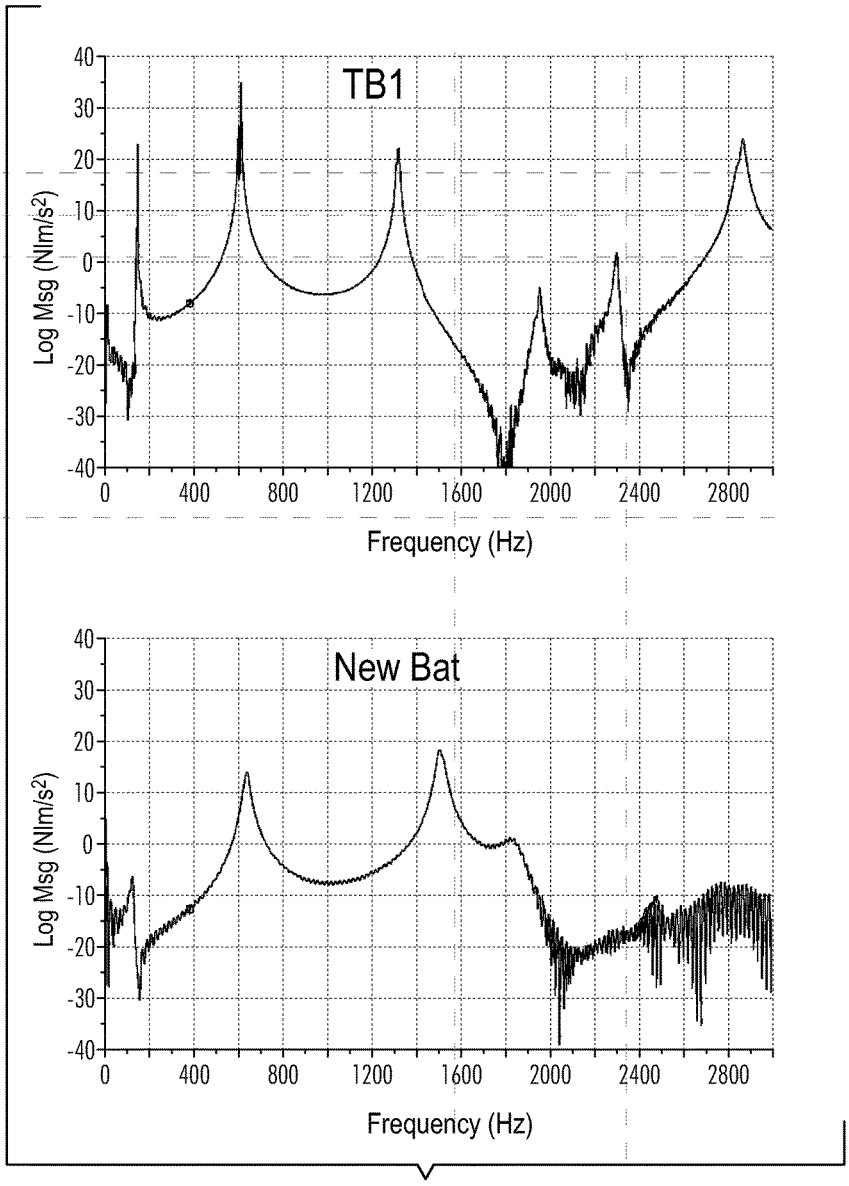
FIG. 12 is a graph of frequency data between a test bat and a bat made in accordance with current disclosure.

In testing, a bat made in accordance with the current disclosure has shown improved performance and better feel as compared to other conventional bats. For example, FIG. 10 shows test data from two test bats and the current inventive bat. Those results are charted in FIG. 11. In all cases, an improvement in bat performance was seen at six testing speeds ranging from 60 mph to 110 mph. Further, FIG. 12 charts the vibrational energy between one of the conventional test bats and the current inventive bat. This chart shows that the current inventive bat has approximately a 60% lower amplitude of vibration at the second node—approximately at the 600 frequency location—which corresponds to the current theory of the location of vibration frequency that most affects the "stinging" sensation to a batter. Please see the world wide web at acs.psu.edu/drussell/bats/sting-damp.html for further explanation.

Thus, although there have been described particular embodiments of the present disclosure of a new and useful Bat with Performance Governing Barrel and Vibration Dampening Connection, it is not intended that such references be construed as limitations upon the scope of this disclosure except as set forth in the following claims.

What is claimed is:

1. A bat for striking a ball comprising:

an axis;

a handle having a knob end, an attachment end, and a handle length separating the knob end from the attachment end, the handle being a continuous structural member from the knob end to the attachment end;

a barrel having an end cap end, a barrel portion, and a transition section, the transition section defining a handle opening opposite the end cap end, the barrel having a barrel length from the handle opening to the end cap end;

wherein the attachment end of the handle is received through the handle opening of the transition section of the barrel such that the handle length overlaps with the barrel length by an overlap, and a gap is defined between the handle and the transition section of the barrel along the overlap;

a joint connecting the transition section to the handle adjacent the attachment end and separating the barrel from the handle, the joint including:

a collar attached to the handle and the transition section of the barrel, the collar including:

an annular collar ring portion having an inner bore attached to the handle between the attachment end and the knob end;

a tapered collar sleeve portion extending from the collar ring portion toward the end cap end of the barrel, the tapered collar sleeve portion including an outer surface attached to the transition section of the barrel; and the tapered collar sleeve portion is longer along the axis than the annular collar ring portion; and a continuous, homogenous, elastomeric spacer ring extending along the entire length of the tapered collar sleeve portion, said spacer ring including a substantially constant radial thickness at all points around any transverse cross-sectional circumference of the spacer ring, the spacer ring attached to the handle and the collar, and received in the gap along the overlap.

2. The bat of claim 1 further comprising:

a securing device attached to the handle proximate to the collar and opposite the knob end; and wherein the securing device is annular in shape and includes an outside diameter that is larger than the handle opening.

3. The bat of claim 2, wherein the collar includes an internal diameter that is smaller than the outside diameter of the securing device and the securing device is longitudinally spaced from the collar.

4. The bat of claim 1, wherein the elastomeric spacer ring is a polyurethane spacer ring having a hardness of between approximately 40-60 shore A.

5. The bat of claim 4, wherein the polyurethane spacer ring has a hardness of between approximately 45-55 shore A.

6. The bat of claim 1, further including an internal support positioned in the attachment end of the handle.

7. The bat of claim 6, wherein the internal support is positioned along the axis and extends past the transition section toward the knob end.

8. The bat of claim 1, further including an external covering positioned on the collar proximate to the transition section, the external covering substantially flush with the transition section and engaging the handle and collar.

9. The bat of claim 1, where the handle and barrel are each comprised of a composite material.

10. The bat of claim 1, wherein:

the tapered collar sleeve portion extends into the gap between the handle and the transition section of the barrel along the overlap; and the spacer ring is received between the tapered collar sleeve portion and the handle.

11. The bat of claim 1, further comprising a securing device attached to the handle proximate to the collar.

12. The bat of claim 11, wherein the securing device is embedded in the spacer ring.

13. A bat for striking a ball comprising:

an axis;

a handle having an internal diameter, a knob end, an attachment end, and a handle length separating the knob end from the attachment end, the handle being a continuous tubular member from the knob end to the attachment end;

an internal support including a support length and having a substantially constant outer diameter along the support length, the internal support positioned inside the internal diameter of the handle adjacent the attachment end of the handle along the axis;

a barrel having an end cap end, a barrel portion, a barrel length, and a transition section, the transition section defining a handle opening opposite the end cap end and operatively attached to the handle;

wherein the attachment end of the handle is received through the handle opening of the transition section of the barrel such that the handle length overlaps with the barrel length by an overlap, and a gap is defined between the handle and the transition section of the barrel along the overlap;

a joint connecting the transition section to the handle and separating the barrel from the handle, the joint including:

a collar including an internal diameter and attached to the handle at a distal end of the collar thereby forming a space between a remainder of the collar and the handle, and attached to the transition section of the barrel;

an annular shaped securing device attached to the handle proximate to the collar and opposite the knob end; and a continuous, homogenous, elastomeric spacer extending along the length of the collar in the space between the remainder of the collar and the handle, attached to the handle and the collar, the spacer received in the gap along the overlap and positioned to separate the remainder of the collar from the handle, said spacer including a substantially constant radial thickness at all points around any transverse cross-sectional circumference of the spacer; and an external covering positioned on the handle proximate to the transition section, the external covering substantially flush with the transition section.

14. A bat for striking a ball comprising:

a handle having a knob end and an attachment end, the handle extending continuously along a handle length from the knob end to the attachment end;

a barrel having an end cap end, a barrel portion, and a transition section, the transition section defining a handle opening opposite the end cap end, the barrel having a barrel length from the handle opening to the end cap end;

wherein the attachment end of the handle is received through the handle opening of the transition section of the barrel such that the handle length overlaps with the barrel length by an overlap, and a gap is defined between the handle and the transition section of the barrel along the overlap; and a joint connecting the transition section to the handle, the joint including:

a collar attached to the handle and the transition section of the barrel, the collar including:

an annular collar ring portion having an annular collar ring outer diameter and an inner bore, the inner bore being attached to the handle between the attachment end and the knob end;

a tapered collar sleeve portion extending from the collar ring portion toward the end cap end of the barrel, the tapered collar sleeve portion including an outer surface, the outer surface attached to the transition section of the barrel, and the outer surface having a tapered collar sleeve outer diameter greater than the annular collar ring outer diameter; and a continuous, homogenous, elastomeric spacer extending along the entire length of the tapered collar sleeve portion, the spacer including a substantially uniform radial thickness at all points around any transverse cross-sectional circumference of the spacer, the spacer received in the gap along the overlap and configured to allow some movement of the handle at the attachment end in relation to the transition section of the barrel.

15. The bat of claim 14, wherein:

the tapered collar sleeve portion extends into the gap between the handle and the transition section of the barrel along at least a part of the overlap; and the spacer is received between the tapered collar sleeve portion and the handle.

16. The bat of claim 14, wherein:

the transition section of the barrel is frusto-conical in shape; and the tapered collar sleeve portion is frusto-conical in shape and is nested inside of the transition section of the barrel.

17. The bat of claim 14, further comprising an internal support received in the attachment end of the handle and extending toward the knob end past the annular collar ring portion.

18. The bat of claim 14, further comprising a securing device attached to the handle and embedded in the elastomeric spacer.

19. The bat of claim 14, wherein an overall radial thickness of the spacer varies along the overlap.

* * * * *